US009120601B2

(12) United States Patent
Maietta et al.

(10) Patent No.: US 9,120,601 B2
(45) Date of Patent: Sep. 1, 2015

(54) MULTI-PHASE ORAL COMPOSITION DISPENSER WITH ADJUSTABLE FLOW

(71) Applicant: The Procter & Gamble Company, Cincinnati, OH (US)

(72) Inventors: Michael Girard Maietta, Cogan Station, PA (US); William Herbert Poff, III, Williamsport, PA (US); Ralph Albert Sagel, Loveland, OH (US); Neil Anthony Strausbaugh, Montgomery, PA (US)

(73) Assignee: The Procter & Gamble Company, Cincinnati, OH (US)

( * ) Notice: Subject to any disclaimer, the term of this patent is extended or adjusted under 35 U.S.C. 154(b) by 35 days.

(21) Appl. No.: 14/096,177

(22) Filed: Dec. 4, 2013

(65) Prior Publication Data

US 2014/0097200 A1 Apr. 10, 2014

Related U.S. Application Data

(62) Division of application No. 12/710,700, filed on Feb. 23, 2010, now Pat. No. 8,622,260.

(60) Provisional application No. 61/168,675, filed on Apr. 13, 2009.

(51) Int. Cl.
*B65D 47/00* (2006.01)
*B65D 35/24* (2006.01)
(Continued)

(52) U.S. Cl.
CPC ..... *B65D 35/242* (2013.01); *A47K 5/18* (2013.01); *B65D 81/325* (2013.01); *B65D 35/00* (2013.01); *B65D 35/22* (2013.01); *B65D 47/261* (2013.01); *B65D 47/265* (2013.01)

(58) Field of Classification Search
CPC ..... B65D 35/00; B65D 35/08; B65D 35/22; B65D 47/26; B65D 47/261; B65D 47/265; B65D 47/08; B65D 81/325; B65D 35/242; A47G 2019/122; A47K 5/18
USPC ..... 222/94, 107, 142.6–142.9, 144.5, 548, 222/564, 547, 554, 556, 145.3, 129, 562, 1
See application file for complete search history.

(56) References Cited

U.S. PATENT DOCUMENTS 2,655,288 A * 10/1953 Caretto ..... 222/142.3
3,130,874 A * 4/1964 Bulmer ..... 222/142.8
(Continued)

FOREIGN PATENT DOCUMENTS

DE 10 2006 054955 A1 5/2008
GB 1 530 893 A 11/1978

OTHER PUBLICATIONS

International Search Report for 11204 dated Feb. 15, 2011.

*Primary Examiner* — Frederick C Nicolas
(74) *Attorney, Agent, or Firm* — Amanda T. Barry

(57) ABSTRACT

A flow control device for dispensing a multi-phase oral composition. The device includes a housing, a restrictor and an insert that fits within and cooperates with the housing and restrictor to dispense the oral composition. A flowpath is formed in and around the insert, as well as in the housing such that the composition passes through one or more channels defined by the cooperative arrangement of the insert and housing. Changes in relative position between the insert and the housing facilitate selective alignment of the various channels with a discharge orifice formed in the housing such that a user can vary the way the proportions of discreet fluids making up the oral composition are dispensed through the orifice.

11 Claims, 5 Drawing Sheets

(51) Int. Cl.

| | |
|---|---|
| ***A47K 5/18*** | (2006.01) |
| ***B65D 81/32*** | (2006.01) |
| *B65D 35/00* | (2006.01) |
| *B65D 35/22* | (2006.01) |
| *B65D 47/26* | (2006.01) |

(56) References Cited

U.S. PATENT DOCUMENTS

| | | | | | |
|---|---|---|---|---|---|
| 3,578,223 | A | | 5/1971 | Armour | |
| 3,737,075 | A | * | 6/1973 | Atchley | 222/142.9 |
| 4,065,536 | A | * | 12/1977 | Lucas | 264/535 |
| 4,164,301 | A | * | 8/1979 | Thayer | 220/253 |
| 4,301,950 | A | | 11/1981 | Funfstuckky | |
| 4,380,307 | A | * | 4/1983 | Stillinger | 222/142.9 |
| 4,500,016 | A | | 2/1985 | Funfstuck | |
| 4,643,881 | A | * | 2/1987 | Alexander et al. | 422/265 |
| 4,705,192 | A | * | 11/1987 | Knapton | 222/144.5 |
| 4,867,354 | A | | 9/1989 | Schreiber | |
| 5,152,431 | A | * | 10/1992 | Gardner et al. | 222/136 |
| 5,301,666 | A | * | 4/1994 | Lerk et al. | 128/203.15 |
| 5,370,275 | A | * | 12/1994 | Mills et al. | 222/136 |
| 5,433,350 | A | * | 7/1995 | Graubart | 222/136 |
| 5,547,091 | A | | 8/1996 | Neveras et al. | |
| 5,702,033 | A | | 12/1997 | Beaver | |
| 6,116,469 | A | * | 9/2000 | Wallays et al. | 222/148 |
| 6,129,243 | A | | 10/2000 | Pal et al. | |
| 6,283,339 | B1 | * | 9/2001 | Morrow | 222/452 |
| 6,302,301 | B1 | * | 10/2001 | Vette | 222/142.6 |
| 6,454,130 | B1 | | 9/2002 | Miller et al. | |
| 6,769,573 | B1 | * | 8/2004 | Kazarian et al. | 222/136 |
| 7,240,795 | B2 | * | 7/2007 | Lee | 206/539 |
| 7,435,027 | B2 | * | 10/2008 | Hetzel | 401/47 |
| 7,510,095 | B2 | | 3/2009 | Comeau et al. | |
| 7,980,432 | B2 | | 7/2011 | Brannon et al. | |
| 8,622,245 | B2 | * | 1/2014 | Zakrzewski et al. | 222/94 |
| 8,622,260 | B2 | * | 1/2014 | Maietta et al. | 222/547 |
| 2004/0173632 | A1 | | 9/2004 | Chan et al. | |
| 2007/0095702 | A1 | | 5/2007 | Park et al. | |
| 2008/0121653 | A1 | | 5/2008 | Zakrzewski et al. | |

* cited by examiner

MULTI-PHASE ORAL COMPOSITION DISPENSER WITH ADJUSTABLE FLOW

BACKGROUND OF THE INVENTION

This invention relates generally to a device for dispensing multi-phase compositions, and more particularly to such a device capable of dispensing user-determined proportions of multi-phased oral compositions such as toothpaste and related dentifrice.

A relatively recent development in toothpaste and related dentifrice compositions is to include multiple material phases (streams) for additional functionality, aesthetics or the like. For example, one phase or stream of toothpaste may include fluoride or related anti-cavity treatment, while another phase may include antibacterial agents, breath treatment, tartar control agents, baking soda, whitening agents or the like. Likewise, multiple streams have been employed to provide visually appealing effects in the dispensed product; such attributes help distinguish the composition from other products on the market. In one form, portions of the multi-phase composition may include stripes, particles or related visually distinct cues.

The different streams may be co-dispensed such that each occupies a separate portion of a generally continuous flow of the oral composition. To effect multi-phase dispensing, the various streams may be segmented into separate reservoirs, or compartments within the dispenser such that when the dispenser is squeezed or otherwise pressurized, the materials from the separate compartments are routed side-by-side through a nozzle or related discharge orifice. In another less precise form, the composition may be loaded into a single-compartment dispenser in such a way as to preserve its multi-phased attributes as the composition is discharged from the nozzle. The efficacy of this latter configuration is generally better when the dispenser's reservoir is relatively full, and falls off as the supply of dentifrice is depleted. In still another form, a partitioned insert may be placed adjacent the nozzle such that different materials making up the multi-phase composition pass through the various insert compartments, thereby being co-dispensed as a whole while substantially preserving their independent features. In all of these configurations, the dispensers are made up of fixed componentry, such that a particular ratio of streams or materials making up the oral composition is determined at the time of manufacture of the dispenser and packaging of the composition therein, and cannot be subsequently adjusted by the user.

There exists circumstances where the ratio of ingredients making up the oral composition may need to be varied according to the needs or preferences of the user. Thus, what is desired is a dispenser that allows for adjustment of the ratio of the flow of one or more materials making up a multi-phase oral composition. What is further desired is such a dispenser that is easy and inexpensive to manufacture and operate.

SUMMARY OF THE INVENTION

These desires are met by the present invention, wherein a device and a method of operating the device to allow variations in a dispensed composition are disclosed. According to a first aspect of the invention, a flow control assembly for a multi-phase oral composition dispenser is disclosed. In the present context, a composition is considered to be multi-phase when it possesses two or more streams being dispensed substantially simultaneously, and where one of the streams differs from the other in at least one material regard. Examples of such differences may include, but are not limited to, visual appearance, chemical composition and textural variations. Specifically, relative portions (or ratios, for example, volume ratios) of the separate streams making up the composition may be varied, thereby enabling the user to achieve a desired amount of a particular stream in the dispensed product. In the present context, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The flow control assembly includes a housing defining a flowpath such that the flowpath terminates in a discharge orifice. The flowpath can fluidly engage a reservoir that together with the assembly makes up a dispenser such that at least a portion of the multi-phase oral composition being dispensed from the reservoir passes through the flowpath and the discharge orifice that is provided for in the housing. The assembly also includes an insert disposed within the flowpath and adjustable so that upon relative movement between the insert and housing, the insert cooperates with the orifice to vary the way the multi-phase composition is dispensed. Thus, the cooperation of the insert and the housing is such that, depending on the setting or position established between them, a single phase or combination of phases of the multi-phase material may be passed through the orifice to be dispensed. A restrictor is used to block at least a portion of the orifice, and can be used to prevent or limit the amount of at least one of the phases that can be dispensed. In this way, a flow of the multi-phase composition that is passing through the orifice is reduced relative to the flow if the restrictor were not present. Specifically, the restrictor is cooperative with the insert such that upon the selective rotation between them, the restrictor defines at least a partial blockage of one or more of the fluidly decoupled channels. The cooperation of the restrictor with the insert and the remainder of the housing allows the multi-phase composition to be co-dispensed, such that, in addition to allowing a single stream of the multi-phase material to be dispensed, two or more discreet streams may be discharged simultaneously, depending on the setting of the housing relative to the insert.

Optionally, the housing is adjustable relative to the insert by being selectively rotatable about a composition-dispensing axis defined in the flowpath. In another option, ribs define numerous fluid channels over the portion of the flowpath that is occupied by the insert. In one form, the fluid channels defined by the ribs may form a channel on the outer surface of the insert that can be used to convey one or more of the phases of the multi-phase composition. Likewise, the insert may include a centrally disposed inner channel that is radially surrounded by and fluidly decoupled from the outer channel discussed above. In this way, a stream situated in or flowing through the outer channel is kept separated from a stream flowing through the inner channel such that no intermixing occurs while those portions of the streams are in the channels. The restrictor may be made from a geometric shape, such as a semicircle, rectangle or triangle. In this way, it may better cooperate with a corresponding shape formed by one or more of the channels formed in the insert. In a particular form, the restrictor is integrally formed with the orifice such that it defines a fixed discharge profile. The housing may additionally include a cap that can cooperate with the housing to act as a closure device for the orifice. In a particular embodiment, the cap is hingedly connected to the housing. The operation of the housing and the flow control assembly resembles a valve, in that the discharge of the composition can be controlled by varying the position of the two relative to one another, while the addition of the cap gives the assembly the ability to shut off discharge flow altogether. One or all of the components making up the assembly may be made from low-cost materials, such as plastic or related resins. Specific examples may include (but are not limited to) acrylonitrile-butadiene-styrene (ABS), polyethylene (PE), polyethylene terapthalate (PET) and polypropylene (PP).

According to another aspect of the present invention, an oral composition dispenser made up of at least a reservoir and flow control assembly is disclosed. The reservoir is configured to contain an oral composition made up of numerous substantially discreet phases and a flow control assembly in fluid communication with the reservoir. In the present context, the term "phase" refers to a physically distinct and substantially homogeneous portion of the oral composition. Such phases may be distinct on the basis of visual, chemical makeup, texture or related attributes. The flow control assembly includes a housing fluidly coupled to the reservoir, where the housing includes a flowpath that allows at least a portion of the oral composition stored in the reservoir to pass through it and a discharge orifice. The flow control assembly further includes an insert situated within the flowpath such that the housing and insert are adjustable relative to one another. The insert defines numerous channels. As with the previous aspect, a restrictor cooperates with channels formed in the insert to allow selective discharge of the discreet phases through the orifice. Thus, where the composition is made up of multiple phases, adjustment of the insert and housing allows the user to vary the relative portions of the phases that are dispensed.

Optionally, the reservoir comprises numerous material compartments, each to contain at least one substantially discreet phase of the composition. In a more particular form, at least two of the reservoir material compartments are arranged concentrically relative to one another. The insert may be rigidly affixed to the dispenser such that the insert and the reservoir do not move relative to one another. In this way, movement is between the housing and the reservoir. The insert may define a generally cylindrical structure along a flowpath axis formed in the insert. Furthermore, the structure may include one or more ribs that can be used to enhance rotational stability of the insert relative to the housing. The ribs, which are placed around the periphery of the insert and oriented along the axial dimension of the insert, help to axially and radially align the outer surface of the insert and the inner surface of the housing; their presence prevents misalignment and wobble from occurring during rotational movement between the insert and housing. In an exemplary form of the channels, the insert may include a single inner channel with numerous outer channels arranged concentrically around the inner channel, where one phase or stream of the multi-phase composition may be fluidly coupled to the inner channel, and where another phase or stream (or phases or streams) of the multi-phase composition may be fluidly coupled to the outer channel. In one form, the numerous outer channels may be formed on the outer surface of the insert, and coincide with the placement of the ribs. In this way, the ribs act as flowpath guides that, in addition to being used for insert stability, wobble-free operation or the like, can help direct the flow of the phase or stream that flows over the outer surface of the insert toward the discharge orifice.

According to another aspect of the invention, a method of making a dispenser of multi-phase oral composition is disclosed. The method includes configuring the dispenser to comprise a reservoir and an adjustable flow control assembly in fluid communication with the reservoir, placing a plurality of discreet phases of the multi-phase oral composition into the reservoir, providing a discharge orifice and selective blockage in the flow control assembly such that one or more of the substantially discreet phases of oral composition may be prevented from being discharged through the discharge orifice, and securing the flow control assembly to the reservoir. In this way, when a user adjusts the flow control assembly, the ratio of the various discreet phases making up the multi-phase oral composition can be dispensed in a manner deemed suitable to the user.

Optionally, the method further includes configuring the flow control assembly to comprise a housing rotatably disposed about an insert. In this way, when a user rotates the housing relative to the insert (such as by twisting one relative to the other), various channels formed in the flow control assembly can cooperate with a restrictor or related flow blockage member to dispense the user-determined ratio. Thus, upon rotation between the insert and the housing, at least one of the segmented discreet phases may be discharged at an amount that is less than others of the segmented discreet phases. Such lower amount can extend all the way down to zero in situations where the restrictor completely blocks off the channel from a discharge orifice. Numerous ribs may be placed around the outer surface of the insert to ensure a wobble-free rotational fit between the insert and housing. The channels may include an inner channel and an outer channel, where the ribs may further segment the outer channel into numerous smaller channels that may help to (with additional sealing) carry a single phase of the discreet phases or define a channel with a unique phase configured to pass through. The outer channel may be concentrically arranged about the inner channel, at least over the portion of the flowpath defined by the insert. The method further includes affixing a cap to the housing. In this way, the cap keeps the composition that is in the dispenser from contacting the ambient environment.

According to another aspect of the invention, a multi-phase oral composition dispensing apparatus is disclosed. The apparatus includes an oral composition reservoir, a multi-channel device configured to at least partially segment one or more of the phases of the oral composition being dispensed from the reservoir, and a flow control device. The reservoir can contain an oral composition that is made up of numerous substantially discreet phases, while the flow control device is in fluid communication with the reservoir and includes a housing and a restrictor. The housing is fluidly coupled to the reservoir and defines a flowpath through which at least a portion of the oral composition dispensed from the reservoir passes. Furthermore, a discharge orifice is provided in the housing. The restrictor blocks at least a portion of the discharge orifice such that a flow of the oral composition dispensed therethrough is reduced relative to a flow if the restrictor were not present. At least one of the housing and the restrictor are adjustable relative to the dispenser such that the relative portions of the discreet phases that are dispensed through the orifice can be varied.

Optionally, the reservoir includes an inner reservoir and an outer reservoir, and in a specific embodiment, the outer reservoir is concentrically placed about the inner reservoir. One portion of the housing may be in selective fluid communication with the outer reservoir, while another portion of the housing may be in selective fluid communication with the inner reservoir. The dispenser may be rotatably coupled to the flow control device such that the selective fluid communication can be varied by rotational movement between the dispenser and at least one of the restrictor and the housing.

Likewise, one of the inner and outer reservoirs may be formed to define a substantially fixed fluid coupling to the discharge orifice while the other may form a variable fluid coupling to the discharge orifice.

In one particular option, the multichannel device is a fitment that is either affixed to or integral with the reservoir. In such configuration, no insert is needed, as the cooperation of the fitment and the reservoir is such that variability of the flow of the multiphase material from the reservoir to the flow control device can be achieved by selective rotation or other similar movement.

In yet another option, the multichannel device comprises an insert coupled to the housing such that the flow control device and the insert together define a flow control assembly. Such a configuration is similar to that of the flow control assembly discussed in some of the previous embodiments.

Other features and advantages of the invention will be apparent from the following description, the accompanying drawings and the appended claims.

BRIEF DESCRIPTION OF THE SEVERAL VIEWS OF THE DRAWINGS

The following detailed description of the present invention can be best understood when read in conjunction with the following drawings, where like structure is indicated with like reference numerals and in which.

DETAILED DESCRIPTION

Figure 1:
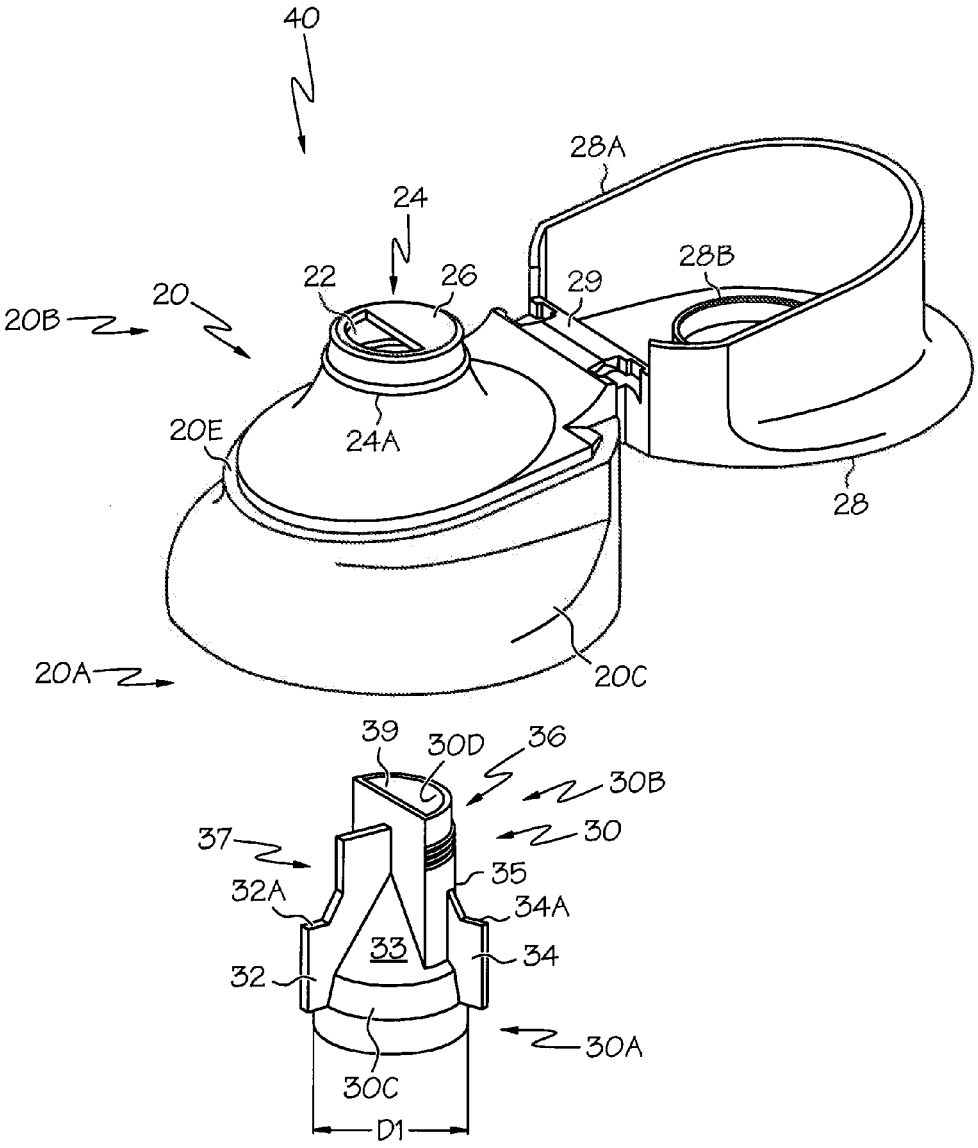
FIG. 1 is an elevation view of an embodiment of the flow control assembly of the present invention.
Figure 2:
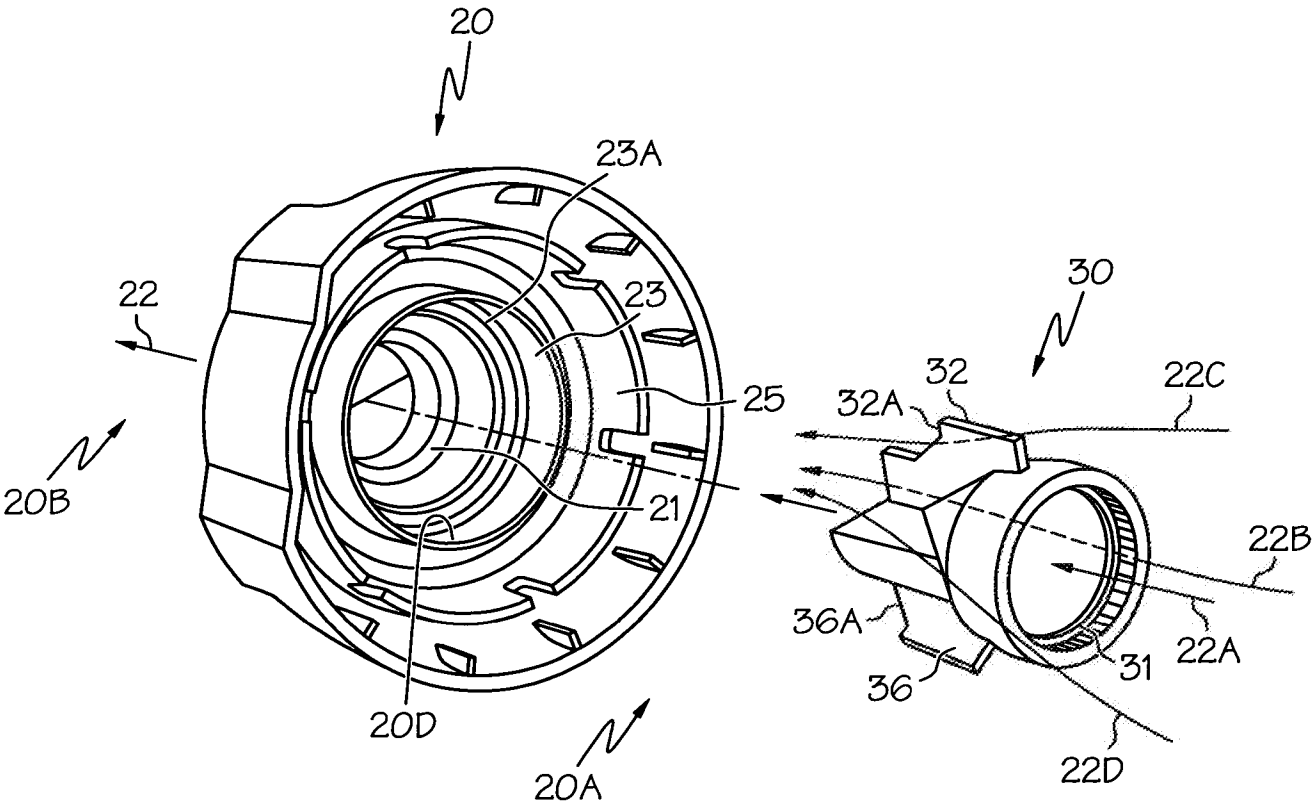
FIG. 2 is a rear perspective view of an embodiment of the flow control assembly of the present invention, with the hingedly-mounted cap of FIG. 1 removed for simplicity.

Referring first to FIGS. 1 and 2, a flow control assembly 40 is shown, made up of a housing 20 and an insert 30. The assembly 40 (and its components, housing 20 and an insert 30) function as devices to facilitate the dispensing of toothpaste or related multi-phase dentifrice compositions. Housing 20 includes an outer surface 20C that is generally exposed to the ambient environment, and an inner surface 20D that can engage insert 30 to facilitate mounting of the latter into the former. In a preferred (although not necessary) embodiment, the housing 20 and insert 30 may be made from lightweight, moldable materials, such as a plastic or related resin. Housing 20 is generally hollow inside such that an axial flowpath 22 extends from the back 20A to the front 20B, the latter of which terminates in a discharge orifice (also called simply, orifice) 24. An oral composition stored in a reservoir (shown and described later) is forced out through the orifice 24 via flowpath 22. A restrictor 26 is integrally formed into the housing 20 such that it partially covers orifice 24. As shown, the restrictor 26 defines a semicircular shape, although it will be appreciated that other shapes, including geometric shapes, such as rectangles, triangles or the like may be employed. As will be discussed in more detail below, the shape of the restrictor 26 can be advantageously made to cooperate with shapes formed by insert 30 and between insert 30 and inner surface 20D of the housing 20 such that when the composition is forced through flowpath 22 from back 20A to the front 20B, discreet portions of the composition can be dispensed in ratios determined by the fraction of the discharge orifice 24 that is open to the ambient environment.

A cap 28 may be attached to the housing 20 through hinge 29. The cap 28, hinge 29 and housing 20 may be formed from a single piece of material such that all three define a unitary structure. Complementary shapes may be formed on the housing 20 and cap 28 so that secure closure may be effected. For example, a radially inward collar 28B is formed on the inner surface of cap 28, and may include an undercut that cooperates with a ring-shaped ridge 24A that protrudes radially outward from the front 20B of the housing that defines orifice 24. Such cooperation can be used to promote a snap-fit connection between the cap 28 and the front end 20B of the housing 20. Likewise, a ledge 20E may be formed about a substantial periphery of the outer surface 20C of housing 20 so that a bottom flange 28A formed in cap 28 can form a close-tolerance engagement with the ledge 20E when the flow control assembly 40 is not being used to dispense product. In this way, the cap 28 keeps ambient air away from orifice 24 such that exposure to the composition inside is reduced.

Insert 30 is sized and shaped to nest within a complementary shape formed on the inner surface 20D of housing 20. As with the housing discussed above, insert 30 includes a back 30A and a front 30B, where the latter is fluidly downstream of the latter. Also like housing 20, insert includes an outer surface 30C and an inner surface 30D, the latter of which defines one of the numerous channels through which the composition may pass on its way out orifice 24. The channels 33, 35 and 37 formed on the outer surface 30C are segmented by ribs 32, 34 and 36 that extend axially along a dimension aligned with flowpath 22. Ribs 32, 34 and 36 have corresponding leading edge 32A, 34A and 36A (the latter of which is not presently shown) that align with a corresponding endwall 23A (shown with particularity in FIG. 2) formed at the axially front end of flange 23. As previously stated, the ribs 32, 34 and 36 enhance rotational stability between the insert 30 and the housing 20, as the relatively close-tolerance fit of the ribs to the inner surface of the housing promotes axially and radial alignment to reduce or eliminate wobble during rotation between the housing 20 and the insert 30. The channels 33, 35 and 37 formed by the space between adjacent ribs may, with additional sealing (not shown), help allow a discreet portion of the composition (for example, that may correspond to separate composition phases as discussed above) to pass through between the housing 20 and insert 30 while maintaining their phase separate from the phase of the channel 39 (in the case of a two-phase composition), or substantially from one another (in the case of a multi-phase composition with more than two phases).

In the insert 30 shown, there are four separate channels formed, including outer channels 33, 35 and 37 defined by the space between the outer surface 30C of the insert 30 and the complementary parts of inner surface 20D of the housing 20 and an inner channel 39 that terminates in a half-cylindrical shape at the front 30B of insert 30. In the configuration shown, the outer channels 33, 35 and 37 form a concentric flowpath around that of the inner channel 39. In one particular form, a first phase of a multi-phase composition may be routed through the flowpath defined by the outer channels 33, 35 and 37, while a second phase of a multi-phase composition may be routed through the flowpath defined by the inner channel 39. Thus, in circumstances where the multi-phase composition is made up of two discreet phases, the outer channels 33, 35 and 37 together can be thought of as forming a single channel for one of the two phases, while the inner channel 39 may be thought of as acting as a conduit for the other of the two phases. In circumstances where the multi-phase composition may include more than two discreet phases, the inventors contemplate that the outer channels 33, 35 and 37 (or some combination of one or more of the outer channels 33, 35 and 37) could each be used to carry a respective phase. The front 30B of insert 30 abuts restrictor 26 that forms part of orifice 24 such that when a channel 33, 35, 37 or 39 aligns with restrictor 26, the flow of that portion of the composition situated in that channel is reduced in proportion to such alignment. Of course, when there is complete alignment such that one or more channels are entirely blocked by restrictor 26, flow through orifice 24 from that channel is substantially cut off.

As shown with particularity in FIG. 2, the various arrows 22A, 22B, 22C and 22D correspond to the four channels 33, 35, 37 and 39 that are defined around and in insert 30. The arrows relate to on oral composition flowpath past insert 30 that is generally defined by the various channels. As can additionally be seen, the inner surface 20D of housing 20 has various concentrically-arranged flanges 21, 23 and 25 that are formed in and extend from the inner surface 20D. As stated above, the endwall 23A formed where the front end of flange 23 meets the back end of flange 21 acts as a seat for leading edge 32A, 34A and 36A of ribs 32, 34 and 36. By their smooth-walled peripheral placement around the flowpath 22, the flanges 21 and 23 allow rotation of the housing 20 relative to the insert 30. Likewise, the fit between the radially outer edges of the ribs 32, 34 and 36 and the cylindrical compartment of flange 23 is tight enough to reduce fluid cross-talk among the channels 33, 35 and 37, but not so great as to appreciably inhibit rotation between the housing 20 and the insert 30. As will be discussed in more detail below, a circumferential ridge 31 formed on the inner surface 30D can be used to engage a complementary surface 11A on the reservoir to substantially affix the two together, such as in a resilient snap-fit relationship.

Figure 3:
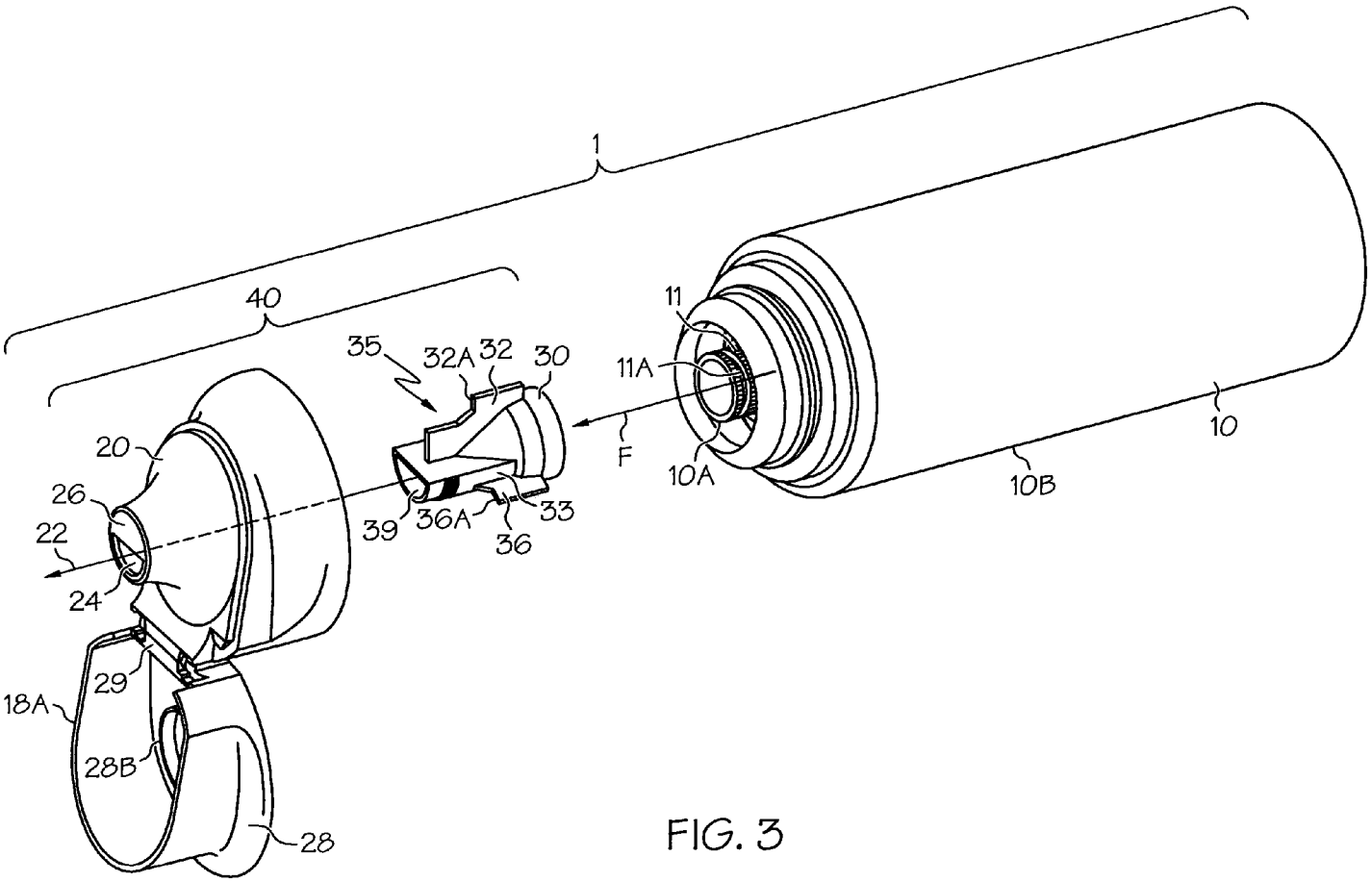
FIG. 3 is an exploded view of a dispenser for a multi-phase oral composition according to an embodiment of the present invention.
Figure 4B:
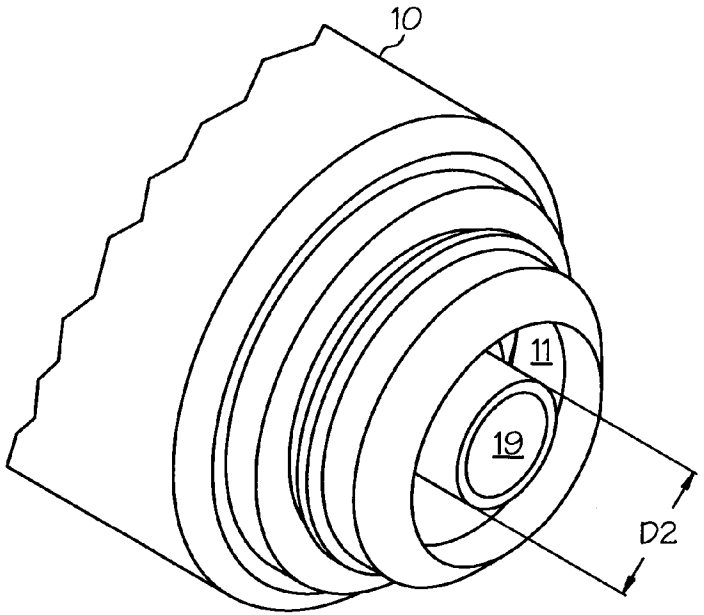
FIG. 4B shows an alternate embodiment of the segmented reservoir of FIG. 4A.
Figure 4A:
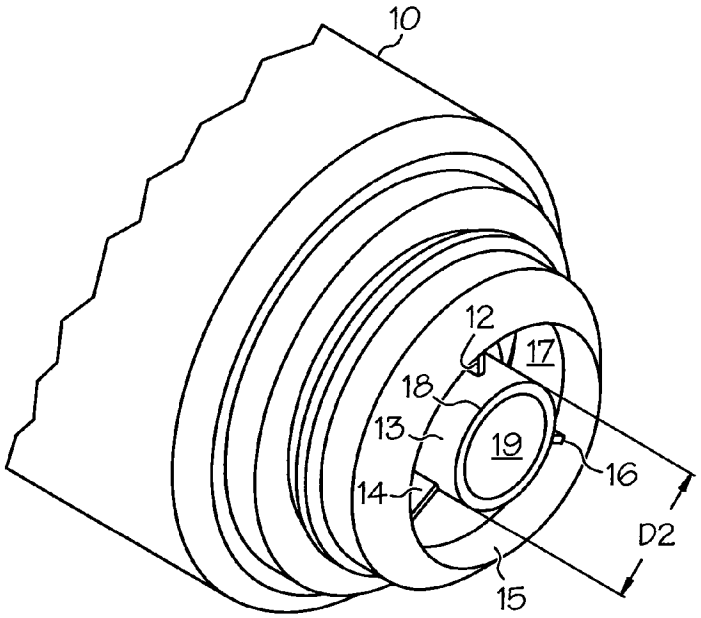
FIG. 4A is a perspective view of a segmented reservoir used to contain a multi-phase composition.
Figure 5:
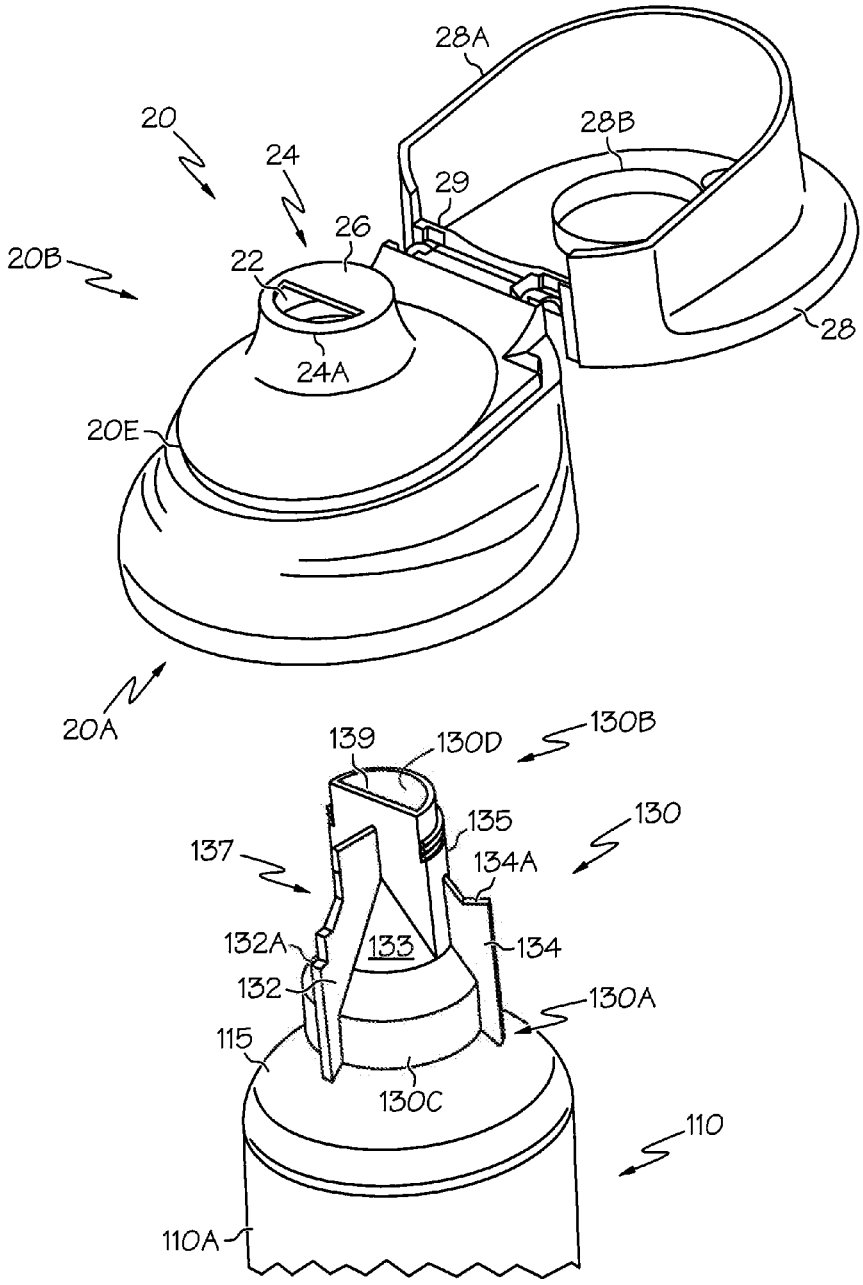
FIG. 5 shows an alternate embodiment of a dispenser for a multi-phase oral composition.

Referring next to FIGS. 3, 4A and 4B, an exploded view of a dispenser 1 and various embodiments of a composition-containing reservoir 10 are shown. The dispenser 1 includes the aforementioned flow control assembly 40 and reservoir 10. Reservoir 10 may be configured in any manner suitable to ensure that the various streams making up the oral composition are fluidly coupled to respective channels formed in the insert 30. Moreover, the reservoir 10 may be configured such that upon the application of pressure (such as by squeezing the tube that makes up reservoir 10 or by actuating a piston or related axial plunger), oral composition contained within the reservoir 10 is forced out through the flow control device 40. The flowpath F of the composition through the entire assembly 1 includes the flowpath 22 that passes through the flow control assembly 40 as previously described. As shown with particularity in FIG. 3, reservoir 10 is made up of a pair of concentric tubes 10A and 10B with an annular space defined between them. The inner tube 10A may be used to contain one of the discreet portions of the multi-phase oral composition, and is defined by an outer diameter D2 (shown in one form in FIGS. 4A and 4B) that is compatible with the inner diameter D1 (shown in FIG. 1) of the insert 30 to facilitate secure connection between them. As with the snap-fit connection formed between the cap 28 and housing 20 discussed above in conjunction with FIG. 1, the inner tube 10A further may include an undercut or flange 11 that can cooperate with the circumferential ridge 31 that projects radially from the inner surface 30D of the insert 30. Such circumferential ridge 31 may be made up of a ring-like structure around the inner periphery (as shown), or by a series of bumps or related protuberances. By combining the undercut or flange 11 with the circumferential ridge 31, a snap-fit is formed between the insert 30 and the inner tube 10A. It will be understood by those skilled in the art that other connections, such as a friction fit, are within the scope of the present invention, and could be employed. In one particular form, a splined fit with complementary longitudinal ridges 11B on the inner tube 10A and 31B on the inner surface of insert 30 adjacent the circumferential ridge 31 cooperate with one another to inhibit rotational movement between the inner tube 10A and the insert 30. Regardless of the connection between the inner tube 10A and insert 30, housing 20, by virtue of the connection between a portion of its inner surface 20D and the ribs 32, 34 and 36 of insert 30, can rotate about the axis formed by flowpath F to allow different settings of the flow control device 40 to be dialed in, thereby varying the proportions of the discreet streams that make up the oral composition. A portion of the flange 25 of the housing 20 may also form a friction fit or snap-fit with the outer tube 10B of reservoir 10. A sealing ring (not shown) may be placed between cooperating surfaces to reduce the likelihood of leakage of oral composition from the reservoir 10. In the form shown, the outer tube 10B includes mounting structure, such as a flange, shoulder or the like to facilitate secure mounting between the reservoir 10 and the housing 20 of the flow control device 40. In a like manner (also shown with particularity in FIG. 3), the end of inner tube 10A includes a taper (i.e., shoulder) to facilitate mounting the insert 30. It will be appreciated by those of ordinary skill in the art that a non-tapered variant (not shown) of both the inner and outer tubes 10A and 10B may also be employed. Referring with particularity to FIGS. 4A and 4B, alternate embodiments of the reservoir 10 with numerous compartments 13, 15, 17 and 19 formed therein is shown. The various compartments can be used to store the various discreet portions of the oral composition. For example, compartments 13, 15 and 17 may include a first portion, while compartment 19 may include a second portion. Examples of such portions may include (but are not limited to) the aforementioned fluoride or related anti-cavity treatment, antibacterial agents, breath treatment, tartar control agents, baking soda, whitening agents or the like. As shown, the inner and outer tubes may each define shoulders at their ends to allow placement of the housing (on the outer tube) and the insert (on the inner tube). In another configuration (not shown), one or both of the inner and outer tubes may include a mid-line divider that splits the tubes into two semicircular halves. Referring next to FIG. 5, an alternate embodiment of the dispenser of FIG. 3 is shown. In the present embodiment, the separate insert 30 of FIGS. 1 through 3 has been replaced by a fitment 130 that is affixed to or integral with reservoir 110, such as through one or more tubes, such as an inner tube 110A. As shown, fitment 130 can be formed with a shoulder-like extension or fairing 115 to promote seating between the inner tube 110A of the reservoir 110 and the housing 20. As shown, fitment 130 has a back 130A, front 130B, outer surface 130C and inner surface 130D. Various ribs 132, 134 and 136 (this last one not shown) divide the fitment 130 into numerous channels 133, 135 and 137 to facilitate the flow of the multiphase material from the reservoir 110. The various ribs have corresponding leading edges 132A, 134A and 136A (this last, like the rib 136 into which it is formed, not shown) that promote rotational stability between the fitment 130 and the housing 20, as well as promote axially and radial alignment to reduce or eliminate wobble during movement between them. A channel 139 can be used to establish selective fluid communication between a material disposed in the reservoir 110 and an axial flowpath 22 formed in orifice 24. In its ability to segment the flow of the multi-phase material, fitment 130 functions in a manner similar to that of insert 30 of FIGS. 1 through 3. While presently shown as being structurally similar to insert 30, it will be appreciated by those skilled in the art that minor configurational changes to the fitment 130 may be made to facilitate coupling to the reservoir 110, whether such coupling is through affixation, integral formation or the like. All documents cited herein are, in relevant part, incorporated by reference. The citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern. While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An oral composition dispenser comprising:

a reservoir configured to contain an oral composition made up of a plurality of substantially discreet phases; and a flow control assembly in fluid communication with said reservoir, said flow control assembly comprising:

a housing fluidly coupled to said reservoir and defining a flowpath through which at least a portion of the oral composition dispensed from said reservoir passes, wherein a discharge orifice is provided in said housing; and a restrictor blocking at least a portion of said discharge orifice such that a flow of the oral composition dispensed therethrough is reduced relative to a flow if said restrictor were not present; and an insert disposed within said flowpath and adjustable relative to said housing such that upon relative movement between said insert and said housing, said restrictor cooperates with said discharge orifice to vary relative portions of the discreet phases that are dispensed through said orifice;

wherein said reservoir comprises a plurality of material compartments, each to contain at least one of the substantially discreet phases; and wherein at least two of said plurality of material compartments are arranged concentrically relative to one another.

2. The dispenser of claim 1, wherein said insert defines at least an inner channel and an outer channel such that said inner channel is fluidly coupled to an inner one of said concentrically arranged material compartments in said reservoir and said outer channel is fluidly coupled to an outer one of said concentrically arranged material compartments in said reservoir such that each inner and outer fluid coupling contains a respective one of the substantially discreet phases.

3. The dispenser of claim 2, wherein said outer channel of said insert is segmented into a plurality of axially fluid compartments by axially disposed ribs formed on an outer surface of said insert such that said ribs engage a complementary inner surface on said housing.

4. A method of making a dispenser for a multi-phase oral composition, said method comprising:

configuring said dispenser to comprise a reservoir and an adjustable flow control device fluidly coupled to one another;

placing a plurality of discreet phases of said multi-phase oral composition into said reservoir;

providing a restrictor and a discharge orifice in said flow control device such that, when the dispenser is being used, at least one of said substantially discreet phases can be selectively blocked from being discharged through said discharge orifice; and securing said flow control device to said reservoir such that, upon subsequent adjustment of said flow control device, a user-determined ratio of substantially discreet phases making up said multi-phase oral composition can be dispensed;

wherein said flow control device comprises a housing rotatably disposed about an insert, said insert comprising a plurality of channels therein such that each of said substantially discreet phases pass through a respective one of said plurality of channels while beige dispensed; and wherein said plurality of channels comprise an inner channel and at least one outer channel, wherein said inner channel forms a first axial flowpath in said insert and said outer channel forms a second axial flowpath between said insert and said housing.

5. The method of claim 4, wherein said outer channel is concentrically arranged about said inner channel along said insert.

6. A multi-phase oral composition dispensing apparatus comprising:

an oral composition reservoir configured to contain an oral composition made up of a plurality of substantially discreet phases;

a multichannel device configured to at least partially segment one or more of the phases of the oral composition being dispensed from said reservoir; and a flow control device in fluid communication with said reservoir and said multichannel device, said flow control device comprising:

a housing fluidly defining a flowpath through which at least a portion of the oral composition dispensed from said reservoir passes, wherein a discharge orifice is provided in said housing; and a restrictor blocking at least a portion of said discharge orifice such that a flow of the oral composition dispensed therethrough is reduced relative to a flow if said restrictor were not present, at least one of said housing and said restrictor adjustable relative to said multichannel device such that upon relative movement therebetween, said restrictor cooperates with said discharge orifice to vary relative portions of the discreet phases that are dispensed through said orifice; and wherein said reservoir comprises an inner reservoir and an outer reservoir.

7. The apparatus of claim 6, wherein said outer reservoir is concentrically placed about said inner reservoir.

8. The apparatus of claim 7, wherein one portion of said housing is in selective fluid communication with said outer reservoir and another portion of said housing is in selective fluid communication with said inner reservoir.

9. The apparatus of claim 8, wherein said reservoir is rotatably coupled to said flow control device such that said selective fluid communication can be varied by rotational movement between said reservoir and at least one of said restrictor and said housing.

10. The apparatus of claim 6, wherein one of said inner and outer reservoirs comprise a substantially fixed fluid coupling to said discharge orifice while the other of said inner and outer reservoirs comprise a substantially variable fluid coupling to said discharge orifice.

11. The apparatus of claim 6, wherein said multichannel device comprises an insert coupled to said housing such that said flow control device and said insert together define a flow control assembly, said housing is adjustable relative to said insert such that upon relative movement between them, at least one channel defined in said insert fluidly cooperates with said discharge orifice and said restrictor to vary the way at least a portion of the oral composition is dispensed through said flow control assembly.

* * * * *